US005606878A

United States Patent [19]

Arreghini et al.

[11] Patent Number: 5,606,878

[45] Date of Patent: Mar. 4, 1997

[54] CLOTHES WASHING MACHINE WITH IMPROVED WATER RECOVERY TANK

[75] Inventors: Luigi Arreghini, Venezia; Silvano Cimetta, Treviso, both of Italy

[73] Assignee: Electrolux Zanussi Elettrodomestici S.p.A., Pordenone, Italy

[21] Appl. No.: 452,097

[22] Filed: May 26, 1995

[51] Int. Cl.[6] ..... D06F 39/02; D06F 39/08

[52] U.S. Cl. ..... 68/17 R; 34/75; 68/18 R; 68/18 C; 68/20; 68/207; 68/208; 68/902

[58] Field of Search ..... 68/902, 18 C, 68/20, 207, 208, 17 R, 18 R; 134/107; 34/75

[56] References Cited

U.S. PATENT DOCUMENTS

| | | | |
|---|---|---|---|
| 2,302,012 | 11/1942 | Dyer . | |
| 2,588,774 | 3/1952 | Smith | 68/902 X |
| 2,931,199 | 4/1960 | Steffey . | |
| 3,295,339 | 1/1967 | Cheyne . | |
| 3,841,116 | 10/1974 | Klein et al. . | |
| 4,154,003 | 5/1979 | Muller | 68/18 C X |
| 4,441,340 | 4/1984 | Kaplan . | |
| 4,810,306 | 3/1989 | Noren . | |
| 5,241,843 | 9/1993 | Hein . | |
| 5,307,650 | 5/1994 | Mertz . | |
| 5,375,438 | 12/1994 | Babuin | 68/17 R |

FOREIGN PATENT DOCUMENTS

| | | |
|---|---|---|
| 0287990 | 10/1988 | European Pat. Off. . |
| 0449060 | 10/1991 | European Pat. Off. . |
| 0467028 | 1/1992 | European Pat. Off. . |
| 2910140 | 9/1980 | Germany . |

*Primary Examiner*—Philip R. Coe

*Attorney, Agent, or Firm*—Pearne, Gordon, McCoy & Granger

[57] ABSTRACT

A clothes washing machine is provided with a tank (2) for the recovery of liquids and a transfer conduit (3) which, by way of a first pump (4) disposed in the conduit, connects the lower portion of the tub (1) to the tank. The lower volume of the tank is connected by way of a suitable conduit (6) and a second pump (7) to a nozzle (8) that discharges into the hydraulic circuit (9) that feeds containers (10) for substances for the washing operation. The machine has one or more of the following properties. The feed pump (7) for the hydraulic distributor (9) and the feed pump (12) for the condenser (11) are replaced by a single pump (17) and by a two-way directional control valve (18) which alternatively feeds respective conduits that feed into the hydraulic distributor and into the condenser. The discharge pump (20) and the transfer pump (4) are replaced by a single pump followed by a further directional control valve (21) which alternatively feeds the transfer conduit or the discharge.

22 Claims, 4 Drawing Sheets

CLOTHES WASHING MACHINE WITH IMPROVED WATER RECOVERY TANK

BACKGROUND OF THE INVENTION

The invention relates to a clothes washing machine, in particular a domestic clothes washing machine, provided with an improved type of tank for the recovery of liquid discharged from the washing tub.

The invention is described with reference to its application in a front loading clothes washing machine provided with a recovery tank disposed vertically on the back of the machine. The invention can advantageously also be applied to other types of clothes washing machines, involving top loading or with the tank disposed in another position within the machine.

Clothes washing machines are known that are provided with one or more tanks for containing liquid substances that are to be used in various phases of a washing program. Such machines are also provided with a further tank for recovery of liquid used during rinsing phases, in particular the last rinsing operation, to be used again in the washing phase in a subsequent washing program.

The advantages of machines of this type (which are described in detail in various previous patents, for example, European Patent Application No. 91104057 to the present applicants, and U.S. Pat. No. 2,931,199) are primarily due to the considerable saving which can be achieved in terms of drawing water from the water mains system. The water is used several times without any need for a further piece of equipment performing the function of a recovery tank, and the tank is installed in the vicinity of the clothes washing machine to which it is connected.

In the course of designing such machines, however, it has been observed that they have some disadvantages which are particular to the type of operating procedure involved and their architecture. In particular, the structure and hydraulic connection of a tank as described in the abovementioned state of the art can cause structural complications and malfunctions which would compromise the utility of such a tank.

SUMMARY OF THE INVENTION

Above all however, it has been noted that the presence of the tank would make it possible to achieve some further functional capacities at a negligible additional cost, and would substantially enhance the value of the machine from the point of view of saving water and time.

It would thus be desirable, and is the aim of the present invention, to be able to provide a clothes washing machine capable of elimination operational disadvantages and affording said further functional capacities by means of some simple, inexpensive improvements utilizing current technology.

According to the present invention, there is provided a clothes washing machine with a washing tub, a drum which is rotatable within the washing tub and capable of containing articles to be washed, and recirculation means for the recovery and recirculation of liquids from the tub. The recirculation means includes a tank for liquids recovered from the tub, the tank being internal to the machine and part of the structure of the machine. A pumping means includes at least one pump for pumping liquid for recirculation. A transfer conduit connects the lower portion of said tub to the internal volume of the tank. The conduit feeds into the tank from the upper side of the tank.

BRIEF DESCRIPTION OF THE DRAWINGS

The invention will be better appreciated from the following description given solely by way of non-limiting example with reference to the accompanying drawings in which.

DETAILED DESCRIPTION OF THE PREFERRED EMBODIMENTS

The term "water" will be used generically in the following description to denote washing solution or rinsing water, but that simplification does not compromise the clarity of the description, having regard to the context in which such terms are used, as will be readily apparent to the person skilled in the art.

Figure 1:
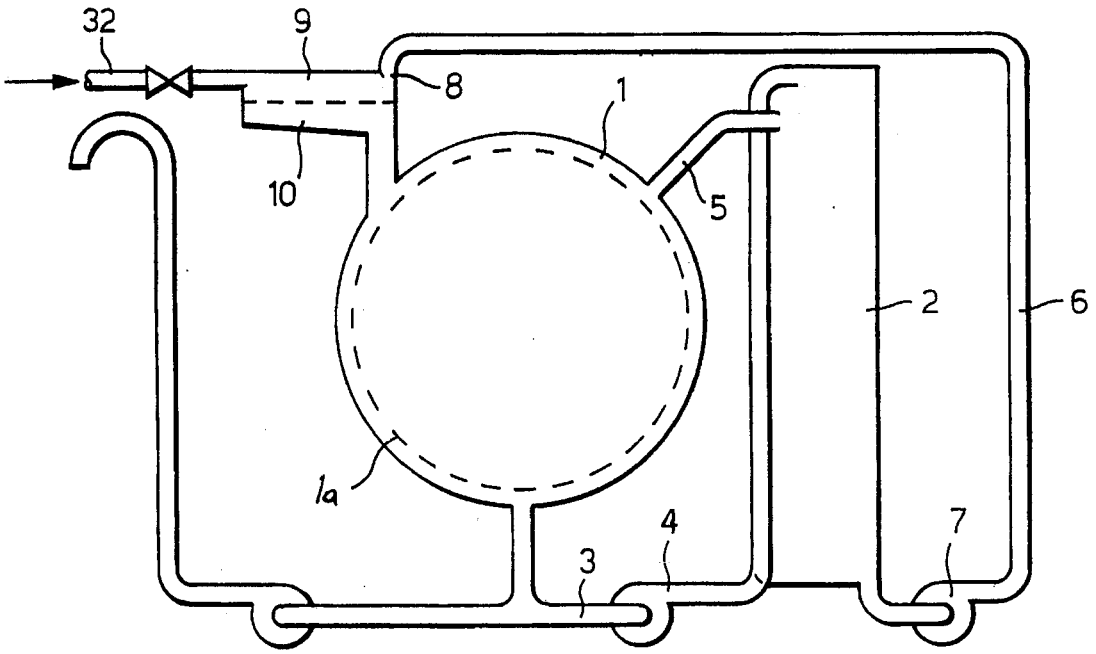
FIG. 1 is a diagrammatic view of a hydraulic circuit of a machine according to the invention.

FIG. 1 shows a preferred embodiment of an apparatus in accordance with the invention and its operating principle.

The clothes washing machine described has a washing tub 1, a perforated drum 1*a* that rotates within the washing tub and capable of containing the articles to be washed, and a recirculation means 3,4,2,7,6 for recovery and recirculation of liquids from the tub 1. The recirculation means includes a tank 2 for collecting and holding liquid for recirculation, this tank 2 being internal to and part of the structure of the machine.

The present invention involves providing a conduit 3 that opens from a top side of a recovery tank 2 for filling the tank with water from the tub 1. This naturally eliminates the need to provide a non-return valve in the conduit 3 for preventing the water from returning to the tub since the fact that the inlet to the tank is not connected at the bottom of the tub causes the water to remain in the tank due to the force of gravity.

Because the inlet to the tank 2 is above the outlet from the tub 1, transfer of the water to and from the tub to the tank is effected by means of a suitable pump 4. The pump 4 is fitted into the conduit at a suitable point, preferably in the lower region of the conduit so that the pump is automatically primed even with a limited level of water in the tub.

Figure 2:
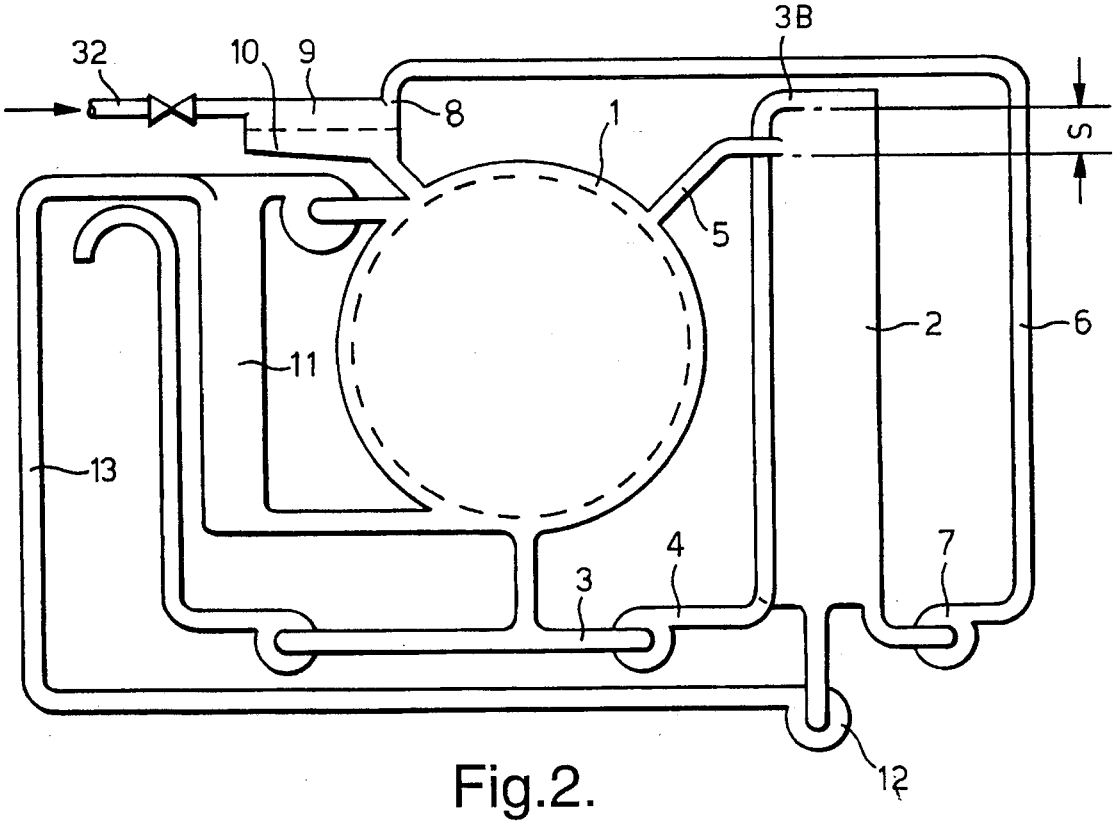
FIG. 2 is a diagrammatic view of a different configuration of the hydraulic circuit of the machine according to the invention.

Advantageously, for the purposes of simplifying the structure of the machine and to prevent a proliferation of hydraulic conduits, part of the conduit 3 for the transfer of water from the tub to the tank is made in one piece with the tank and opens in the upper portion of the tank by way of a transfer nozzle 3B, as is diagrammatically shown in FIG. 2. It will be apparent that there may also be situations in which, either due to an excessive amount of water in the tub or due to previous initial filling of the tank, the water transferred into the tank tends to fill it completely, giving rise to disadvantages of various natures, which the person skilled in the art can easily imagine.

To prevent that from happening, a spill tube 5 is disposed within the upper portion of the tank. The other end of the tube 5 is connected to the interior of the tub, as FIG. 2 also shows. The tub is connected to the external atmospheric pressure by way of a conduit which carries substances used for the washing operation in the tub. Thus, the upper portion of the tank is also automatically and permanently in communication with the external atmosphere. This avoids the tank being put under pressure during the filling thereof, which would prevent complete filling of the tank by virtue of the increased pressure which would be created in its empty upper portion.

In theory the spill level of the spill tube 5 could independent of the level of the transfer nozzle 3B. However, if the nozzle 3B is at a level lower than the spill level, the situation could arise where the tank portion above the nozzle 3B is also filled. In that case, when the pump 4 is stopped, the liquid above the nozzle 3B would return to the tub, by passing through the pump, and that would certainly reduce the effective capacity of the tank. To avoid that, it is preferred that the spill level of the spill tube 5 is disposed lower than the filling nozzle 3B and at a certain safety level difference as indicated at S.

Returning now to the main functional aspect of tank 2, the aim thereof is to recover water that is discharged in one or more rinsing phases to be reused in the first washing or pre-washing phase in a subsequent washing cycle. For that purpose, it is necessary for the water in the tank to perform all the functions previously performed by the water drawn from the outside water mains system. In particular, a sufficient pressure is required to carry away the substances used for the washing operation, which are poured into means for holding such substances, such as well-known "detergent drawers" 10. That functional aspect is implemented by means of a specific conduit 6 connected between the bottom of the tank 2 and a nozzle 8 that feeds hydraulic distributor circuit 9. The distributor circuit 9 discharges into the drawers 10 for the washing substances. To cause the water to be transferred again from the tank to the hydraulic circuit, and to do that under the pressure required to carry away the substances used for the washing operation, a pump 7 having suitable characteristics in respect of pressure and capacity is disposed in the conduit 6.

A problem that confronts the designer of such a machine concerns the method of detecting when the tank 2 is completely filled and consequently stopping the filling pump 4. The procedures involved in detecting the filling of a tank or a given level are many and well-known, however all require the use of at least one suitable sensor and associated members for controlling the pump, thus complicating the machine and making it more expensive. However, when the machine is already provided with an electronic operating and control circuit, normally a microprocessor, for execution of the normal phases in the cycle, it becomes particularly advantageous and easy to use a circuit that already exists. The invention integrates the capacities of the existing circuit with a signal coming from a level sensor (such as a pressostat) that is already fitted in mass production to such machines and which is used precisely for detecting the level of water in the tub. In fact, when the tank 2 is filled, the water that is above the spill level of the spill tube 5 is discharged by that tube into the actual tub. Thus, a stabilized situation in regard to the circulation of water in a closed cycle is virtually immediately established. The exact amount of water taken from the bottom of the tub passes into the tank in order to issue immediately therefrom and return to the tank. This quickly provides for stabilization of the level of water in the tank, which naturally means that the tank 2 is full.

If therefore the operating and control circuit is programmed to detect when the signal in respect of the level of water in the tub coming from the above-mentioned level sensor permanently stabilizes at the same level for a limited and definite time, then the signal in respect of filling of the tank is automatically obtained in that circuit. That circuit can thus be enabled to interrupt, using suitable known means, the supply of electrical power to the pump 4 for transfer into the tank 2.

As stated the advantage of that procedure is afforded by the fact that filling of the tank and stopping of the pump 4 are controlled without any additional sensor in the tank, but merely with suitable programming of the well known operating and control circuit.

Various situations are naturally possible in regard to use of the water in the tank. The most common is when, for various reasons, the amount of water in the tank is not sufficient for the phase involving treating the load in the tub for which it was recovered, for example, when a considerable amount of water is required, or the tank is only partially filled. Under those circumstances suitable programming of the above-mentioned operating and control circuit is capable of discharging all the water available from the tank to the tub by activating the pump 7 disposed in the conduit 6. If the water returned to the tub is still not sufficient, a situation which can be detected by a procedure generally similar to that just described above, the control circuit is then capable of stopping operation of the pump 7 and activating an electrically operated valve disposed between the external hydraulic circuit and the hydraulic distributor 9 for adding water up to the level required in the tub by taking water from the external mains system, precisely as in the case of conventional machines.

One opportunity afforded by the presence of the tank 2 involves integrating the operation of the tank into an integrated machine for washing and drying laundry. The drying process is effected using a method referred to as the "condensation" method which is well known to the person skilled in the art and which is not described herein for the sake of brevity.

In the drying procedure an improvement according to the invention involves using the water contained in the tank 2 for spraying into a condenser 11 by means of a suitable pump 12 disposed in a specific conduit 13. An intake mouth opening at the conduit 13 is connected to the bottom of the tank. Water from the tank is collected in the bottom of the condenser and pumped into the tank again, preferably by means of the same pump 4 used for transfer from the tub to the tank, as is diagrammatically shown in FIG. 2. In fact the water in the condenser is not contaminated in the slightest, because water from a condenser tank, which serves as a condensation means, is in no way affected by the fabrics or the discharge circuit, which may be dirty, and because the small amount of condensed moisture is in the state of vapor and therefore substantially free from impurities.

This solution affords a further significant advantage in terms of saving water. In fact the water recovered from the last rinsing operations is used again twice: a first time for condensing the moisture in the drying air in the following drying phase, when required, and a second time for the load of water in the tub for the washing operation in the subsequent cycle. The advantage of that solution in a combined machine for washing and drying laundry is that the amount of water recovered in the tank 2 from the last rinsing operation is around 15 liters. The water consumed from the mains system for a moisture condensation phase is around 24–25 liters (for a load of laundry of 2.5 kg), which is totally saved by reusing the water in the tank and by re-circulating it nearly twice. On the other hand this does not have a substantial adverse effect on the condensation result since that water increases the actual temperature only to an imperceptible degree. The load of water for the subsequent washing operation is about 15 liters, which can thus be taken entirely from the tank whose water has already been used during the condensation operation.

In the situation however where the load of laundry is the normal load of 5 kg, there would be a consumption of water for the condensation operation of 50 liters, which, in the hypothesis of completely repeated re-use of the water from the tank, would be completely saved and would be added to the 15 liters recovered in the washing phase of the subsequent cycle. That would therefore afford a maximum total theoretical saving of water of as much as 25+25+15=65 liters, in comparison with an overall consumption of 60+25+25=110 liters before the present invention, a maximum theoretical percentage saving of slightly more than 50%. However this theoretical calculation leaves out of consideration the fact that the water which is used several times for the condensation operation is progressively increased in temperature, which has a corresponding adverse effect on the general levels of drying performance. In order to remedy this disadvantage, it is possible to provide a suitable thermostat for measuring the temperature of the water in the tank. The thermostat is suitably connected for interrupting operation of the delivery pump 12 for delivery of the water from the tank 2 to the condenser 11. Instead water is fed to the condenser directly in a conventional way from the external mains system when the temperature exceeds a value which is predetermined depending on the efficiency of condensation. For the sake of brevity and having regard to the clarity of the description, the procedures described are not illustrated in a figure, insofar as a person skilled in the art is perfectly capable of understanding the teaching and carrying it into effect.

Figure 3:
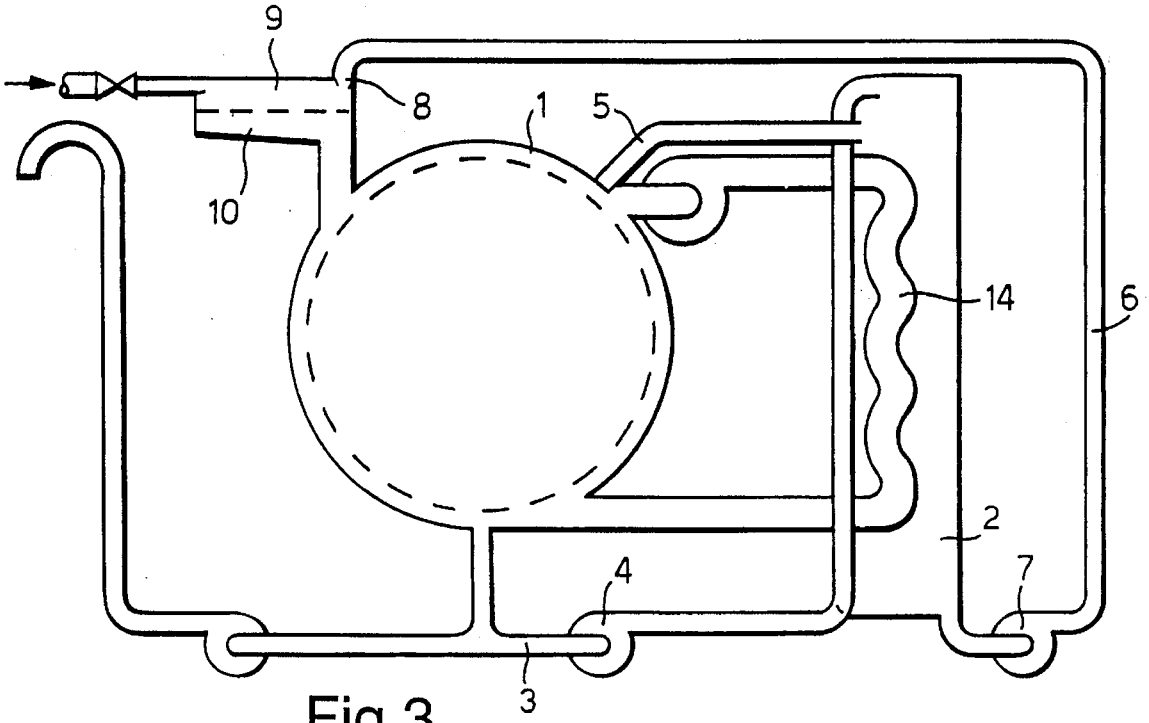
FIG. 3 shows an alternative form of the FIG. 2 circuit.

An alternative form of the procedure involving use of the tank for the condensation function is diagrammatically shown in FIG. 3. Condensation of the moist air circulated within the tub is not effected in a separate condenser, but is effected by passing a drying air circulating conduit 14 with pipe coils external to the tub through said tank. The condensing agent is no longer the spray of cold water which intercepts the flow of moist hot air, but rather the internal wall of the conduit 14 is cooled by the cold water in the tank 2 in which the conduit is immersed. Such a construction has further advantages, such as eliminating the pump 12 for delivery to the condenser, and saving space otherwise required for the condenser. In a machine of standardized dimensions also containing the components for the drying function and the tank, such space is extremely difficult to find within the external casing.

Figure 4:
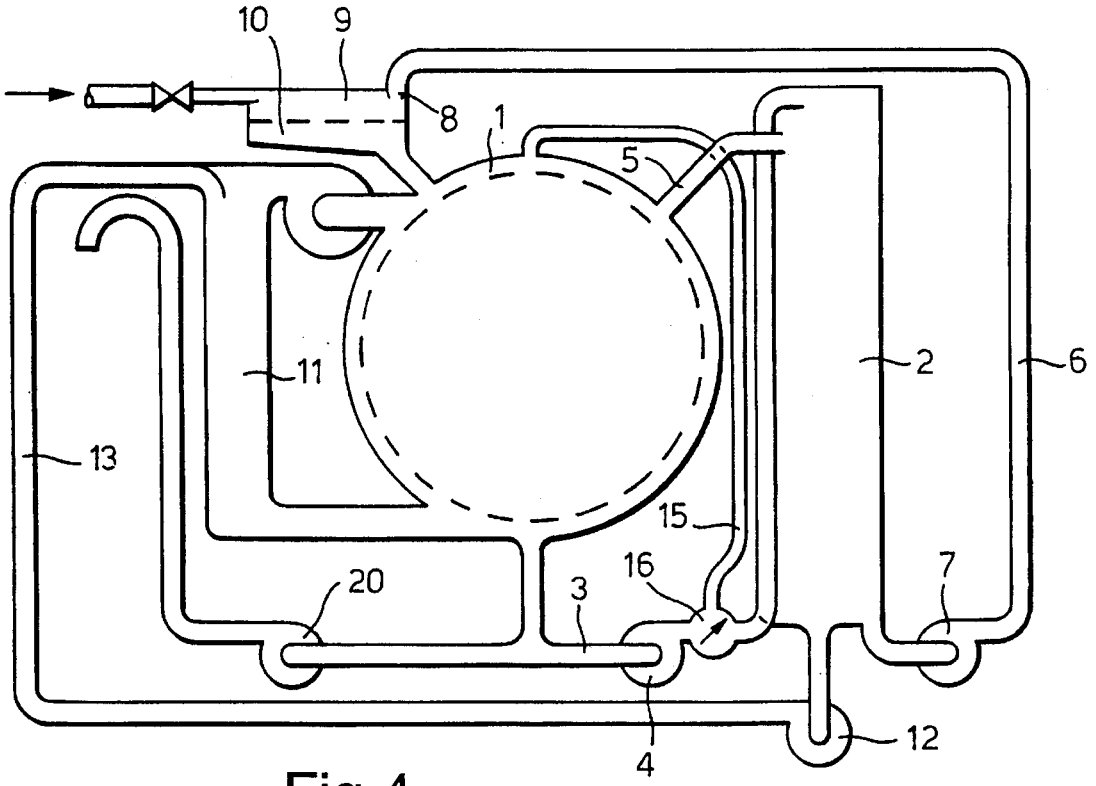
FIG. 4 and 5 show two further configurations of the hydraulic circuit of the machine according to the invention.

A further way of optimizing the configurations described above is shown in FIG. 4. Shown there is a machine in which the liquid within the washing tub is continuously extracted and re-introduced into the tub in accordance with the wellknown procedure referred to as "re-circulation". A machine of this type comprises a further conduit 15 and an associated pump for effecting the recirculation of the liquid to the tub. A machine of this type would have to have an undoubtedly high number of pumps and conduits: the transfer pump 4, the pump 7 for supplying the hydraulic distributor 9, the pump 12 for supplying the condenser, the discharge pump 20, and also a recirculation pump. To avoid such a proliferation, one of the pumps which is already present is used for also effecting the recirculation function. Preferably, the configuration adopted is that shown in FIG. 4 where the conduit portion 3 from the transfer pump 4 to the tank is interrupted by a directional control valve 16 which diverts the flow produced by the pump 4 either to the tank or to the recirculation conduit 15, depending on the command imparted to the valve 16. It is preferable for the transfer pump 4 also to be used as the recirculation pump since that pump already has the required characteristics in regard to good delivery but low pressure, features that are common both to the recirculation procedure and the procedure involving transfer to the tank.

Figure 5:
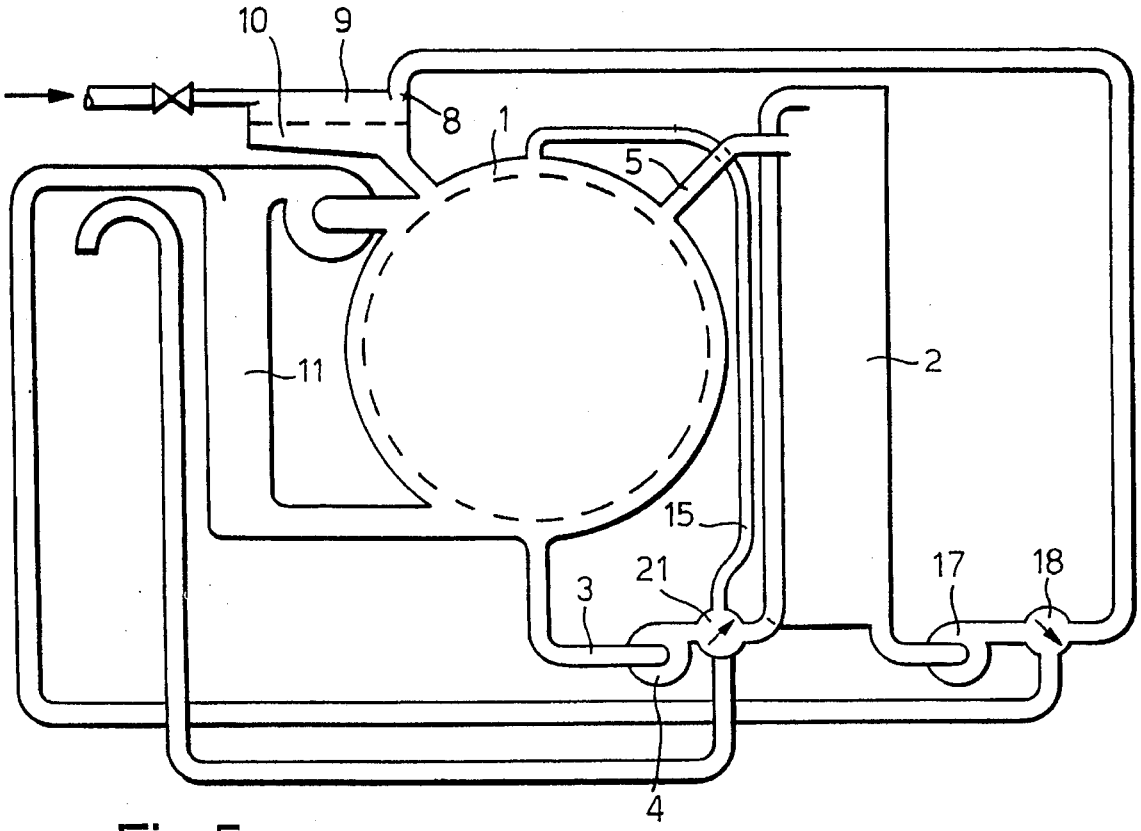

Other ways of optimizing the elements associated with the tank are also possible. For example, referring to FIG. 5, the pump 7 for supplying the hydraulic distributor 9 and the pump 12 for supplying the condenser may be replaced by a single pump 17 and a suitable directional control valve 18. The valve 18 alternatively connects to respective conduits communicating with the hydraulic circuit of the distributor 9 and the condenser 11. The discharge pump 20 may also be integrated with the transfer pump 4. The discharge function is then effected by a further suitable directional control valve 21 in the transfer conduit 3 having three different outlets alternatively feeding the transfer to the tank, recirculation, or discharge.

Figure 6:
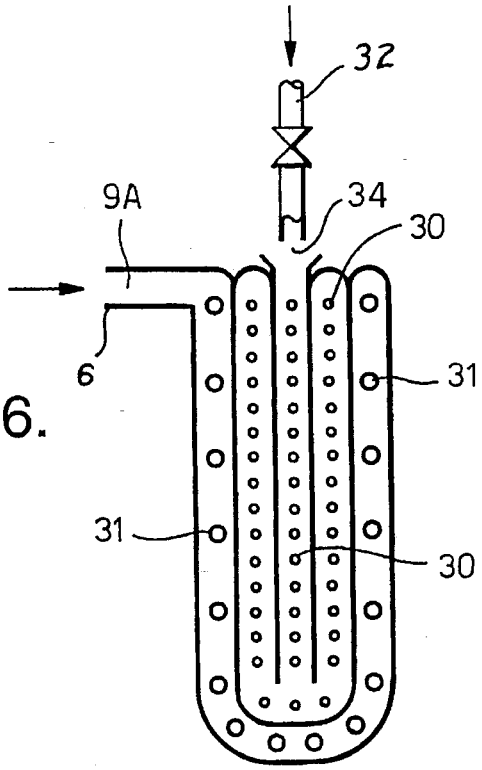
FIG. 6 is a circuit for distributing water over the washing substances, which is improved in accordance with the invention.

A further improvement is diagrammatically illustrated in FIG. 6 where a second or auxiliary hydraulic circuit 9A for the distribution of water coming from said second pump 7 feeds the containers 10 for substances for the washing operation. The second circuit is separate from the hydraulic circuit 9 for the distribution of water coming from the external water mains system. The advantage of this second hydraulic circuit depends on the fact that the mains pressure is normally variable within wide limits, between 0.3 and 10 atmospheres. To ensure an adequate pressure for the washing substances contained in the drawers 10 to be drained therefrom, holes 30 for the discharge of water from the mains hydraulic distribution circuit 9 must be sufficiently small. However that creates a danger that any lint or other small impurities present in the water from the tank which are reintroduced into the circuit 9 would block the small holes, with disadvantages that can be easily imagined. In addition, the variability of the mains pressure makes entrainment of the washing substances a slightly inconsistent procedure.

It is possible to avoid those disadvantages by providing the second water distributor circuit 9A which is separate from the first and which is connected to the second delivery pump 7 by means of the conduit 6. The second circuit is supplied by the pump 7 and thus at a substantially constant pressure. The second hydraulic circuit 9A can be designed with water flow holes 31 that are substantially larger than the holes 30, in such a way as to avoid the risk of their being blocked. The pressure within the second hydraulic circuit 9A can be maintained at the desired level by suitably selecting the characteristics of the second pump 7.

Figure 7:
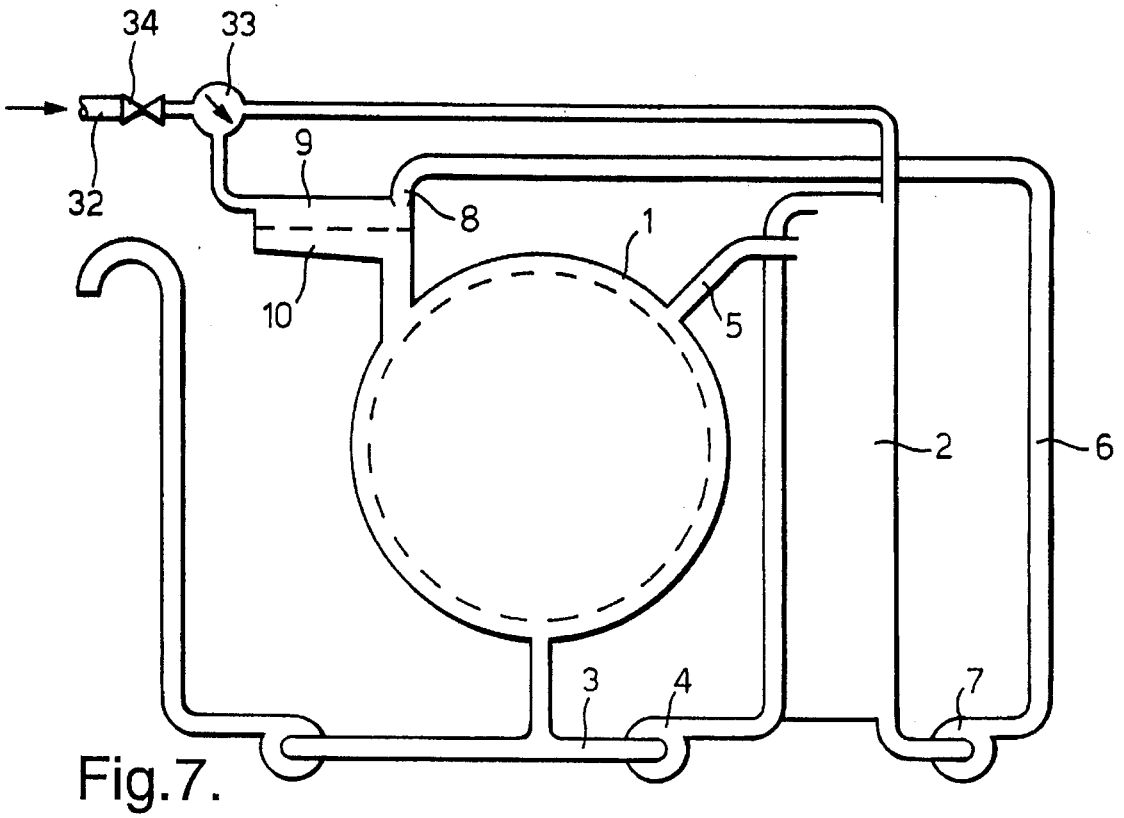
FIG. 7 and 8 show two further improvements in the configurations of the hydraulic circuit according to the invention.

Referring to FIG. 7, further improvement can be achieved by considering that the tank 2 is repeatedly filled with rinsing water which contains a certain level of impurities. After a long period of operation it is apparent that those impurities can contaminate the tank and, remaining there, can give rise to problems in regard to hygiene and blockage of the associated conduits. To avoid that disadvantage the water supply circuit 32 for supplying water from the external mains system is intercepted by a directional control valve 33 whose outlet can be selectively connected to the hydraulic circuit for the distribution of water coming from the external mains 7 system or to said tank 2, as diagrammatically illustrated in FIG. 7. The directional control valve 33 is preferable disposed downstream of an air break location as indicated at 34 so as to not substantially reduce the feed pressure.

In that way, by suitably operating on the controls which act on the directional control valve 33, it is possible for the flow of water from the external water mains system to be diverted permanently or intermittently, depending on the preselected operational procedures, directly into the tank 2. The flow of mains water automatically and effectively clears the tank of residue and dirt which may be present therein.

Figure 8:
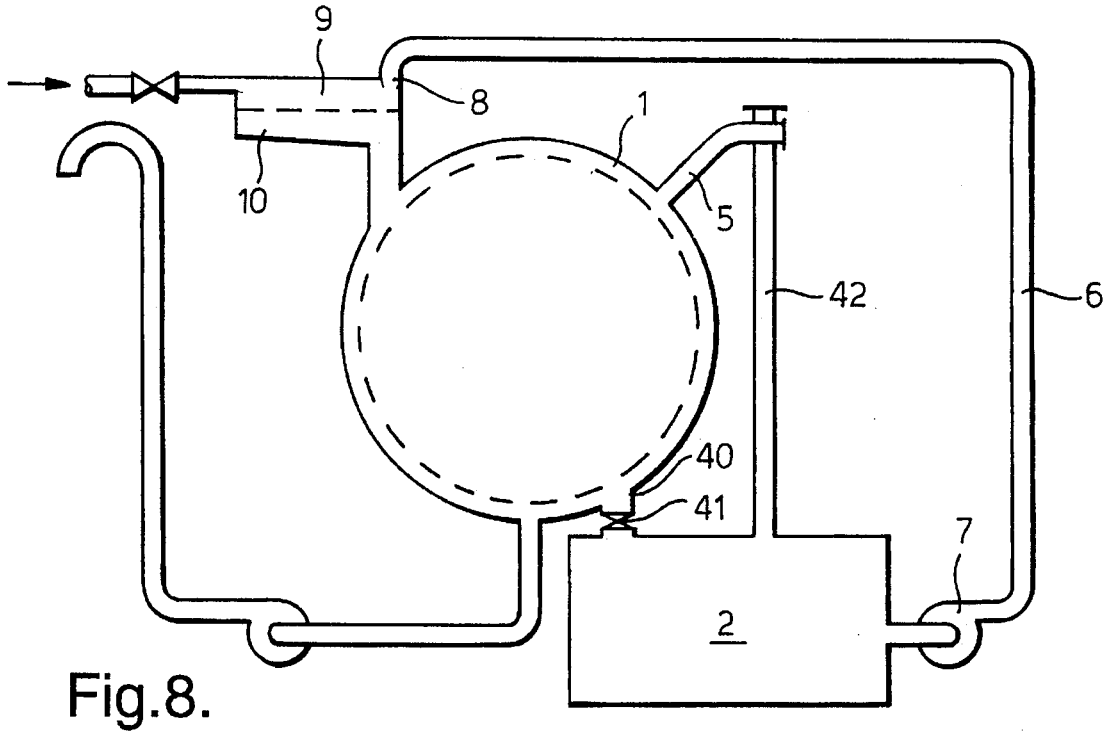

An advantageous improvement in the solution set forth hereinbefore involves disposing the tank 2 in a lower position in the cabinet, preferably in the bottom of the cabinet and with the upper portion of the tank disposed at a level which is lower than the lower level of the tub, as shown in FIG. 8. In fact this configuration permits a substantial simplification in the structural configuration of the accessory components and the tank, since in that cast the tank can be filled simply under the effect of the force of gravity, the water being transferred from the tub to the tank by means of suitable conduit 40.

It will be appreciated that it is necessary to ensure that the transfer phase does not take place during the washing or rinsing periods in which naturally the water must remain in the tub. Therefore the flow of water in the conduit 40 must be regulated by suitable means such as for example an electrically operated valve 41 which is arranged to close the conduit 40. That makes it possible for the tank to be designed in a simplified manner, and to save on the transfer pump 4. The requirement for a breather for the tank is immediately met by means of a suitable breather pipe 42 which extends from the tank and which rises above the top of the tank and tub.

A further simplification and advantage is enjoyed because there is no longer any need to monitor the moment at which the tank is filled in order to stop the transfer pump 4. Filling of the tank occurs automatically when the electrically operated valve 41 is opened, that valve permitting total filling of the tank if the amount of water in the tub is equal to or greater than the capacity of the tank, or partial filling of the tank in the opposite case. In any case the amount of water which flows from the tank is a pre-imposed datum which can be deduced from the amount of water in the tub, that datum already being previously known from the cycle. The last configuration as just illustrated is naturally compatible with and applicable to all the other technical solutions and variations describe hereinbefore, needing modifications and adaptations which are obvious and within the capability of any man skilled in the art.

It will be apparent that the person skilled in the art can ascertain other technical solutions and arrive at other forms of optimization in terms of use of the tank and the associated members by having recourse to the normal skills and knowledge in the art. Although the invention has been described with generally known terminology, it is not to be deemed limited by the examples given, since the person skilled in the art can make numerous modifications and alteration. It will be appreciated therefore that the accompanying claims embrace such obvious modifications which are apparent to the person skilled in the art and which are within the scope of the present invention.

We claim:

1. A clothes washing machine comprising: a washing tub with an outlet; a drum which is rotatable within the washing tub and adapted for containing articles to be washed; recirculation means for recovery and recirculation of liquids from the tub, said recirculation means comprising a tank for holding liquids recovered from the tub, and a conduit for delivering liquid from the tank to a nozzle associated with a hydraulic distributor for distributing liquid to containers of substances used in a washing operation, said tank being internal to said clothes washing machine and part of a structure of the clothes washing machine; a transfer conduit connecting the outlet of said tub to an internal volume of said tank, wherein said transfer conduit feeds into said tank from an upper side of the tank; and pumping means including a transfer pump for pumping liquid through the transfer conduit from the outlet of the tub to the tank.

2. A clothes washing machine according to claim 1 wherein the pumping means further comprises a hydraulic distributor feed pump for pumping liquid from the tank to said nozzle.

3. A clothes washing machine according to claim 2, further comprising an auxiliary hydraulic circuit through which the hydraulic distributor feed pump supplies said containers with liquid, said auxiliary hydraulic circuit being separate from a main hydraulic circuit for the distribution of water from an external mains system.

4. A clothes washing machine according to claim 3, wherein the auxiliary hydraulic circuit for the distribution of water coming from the hydraulic distributor feed pump has a plurality of holes for water to fall therefrom, said holes being of a substantially larger size than holes for water to fall from the main hydraulic circuit for the distribution of water coming from the external water mains system.

5. A clothes washing machine according to claim 2, further comprising a diverter valve and a condenser for condensing moisture from articles so as to dry the articles, and wherein the hydraulic distributor feed pump is used for pumping liquid from the tank to the condenser and the diverter valve is used selectively to deliver liquid from the hydraulic distributor feed pump to the nozzle or the condenser.

6. A clothes washing machine according to claim 1 wherein the clothes washing machine is operable as a laundry drier and further comprises a condenser for condensing moisture from articles being dried.

7. A clothes washing machine according to claim 6, wherein liquid from the tub is used to cool the condenser.

8. A clothes washing machine according to claim 6, wherein the condenser is located at least partially in the tank.

9. A clothes washing machine according to claim 6 further comprising means for delivering liquid from the tank to cool the condenser.

10. A clothes washing machine according to claim 6, wherein the pumping means further comprises a condenser feed pump for pumping liquid from the tank to the condenser.

11. A clothes washing machine according to claim 10, further comprising a thermostat associated with said tank, said thermostat being connected to interrupt operation of the condenser feed pump and direct water from an external mains system into the condenser when said thermostat detects a temperature higher than a preset value.

12. A clothes washing machine according to claim 1, wherein a portion of the transfer conduit is integral with the tank.

13. A clothes washing machine according to claim 1, further comprising a spill tube connecting an upper portion of the tank to the internal volume of the tub to return excess liquid in the tank to the tub.

14. A clothes washing machine according to claim 13, wherein said transfer conduit discharges into the tank at a level above the level at which the spill tube discharges from the tank to the tub.

15. A clothes washing machine according to claim 1, further comprising a recirculation conduit for recirculating liquid from the outlet of the tub to an inlet of the tub during a washing operation.

16. A clothes washing machine according to claim 15, further comprising a diverter valve to selectively direct liquid from the transfer pump either to the tank or through said recirculation conduit.

17. A clothes washing machine according to claim 16 wherein the diverter valve is a three-way valve for selectively directing liquid from the transfer pump to the tank, to the recirculation conduit, or to a discharge outlet.

18. A clothes washing machine according to claim 1, further comprising means for selectively directing liquid from the transfer pump to the transfer conduit or to a discharge outlet from the clothes washing machine.

19. A clothes washing machine according to claim 1 wherein operation of the transfer pump is stopped after a level of liquid in the tub remains substantially at a same value for a predetermined period.

20. A clothes washing machine according to claim 19, further comprising a sensor and a processor, said sensor measuring the level of liquid in the tub and transmitting a signal representative thereof to the processor, said processor monitoring the signal and initiating counting of the predetermined period each time the value of the signal changes, said processor stopping the transfer pump when the predetermined period is reached.

21. A clothes washing machine comprising:

a wash tub having a return inlet and an outlet, said outlet being located in a bottom portion of the wash tub;

a drum rotatable within the wash tub and adapted for holding articles to be washed;

a tank for holding liquid recovered from the wash tub, said tank having a transfer inlet and an overflow outlet;

a transfer conduit connecting the outlet of the wash tub to the transfer inlet of the tank;

a transfer pump for pumping liquid through the transfer conduit from the outlet of the wash tub to the transfer inlet of the tank; and a spill tube connecting the overflow outlet of the tank to the return inlet of the wash tub, said spill tube permitting excess liquid in the tank to flow into the wash tub.

22. The clothes washing machine of claim 21 wherein a portion of the transfer conduit is integral with the tank.

* * * * *